US005092083A

United States Patent [19]

Raffaelli

[11] Patent Number: 5,092,083

[45] Date of Patent: Mar. 3, 1992

[54] FLY CUTTER GENERATOR WHEEL WITH NOVEL DIAMOND GRIT CONFIGURATION TO ELIMINATE LENS FRACTURE AND BACK CUTTING

[75] Inventor: Dennis R. Raffaelli, Rochester Hills, Mich.

[73] Assignee: Inland Diamond Products Company, Madison Heights, Mich.

[21] Appl. No.: 641,685

[22] Filed: Jan. 16, 1991

[51] Int. Cl.[5] ..... B24D 7/14; B24D 7/18

[52] U.S. Cl. ..... 51/209 R; 51/181 R; 51/206.5; 407/40

[58] Field of Search ..... 51/206 R, 206.4, 206.5, 51/207, 181 R, 181 NT, 209 R, 124 R, 284 R; 407/40, 53, 42, 34

[56] References Cited

U.S. PATENT DOCUMENTS

| | | | |
|---|---|---|---|
| 2,600,815 | 6/1952 | Turner | 51/284 |
| 3,374,586 | 3/1968 | Stone | 51/206 R |
| 3,816,997 | 6/1974 | Rupp | 51/124 L |
| 3,831,236 | 8/1974 | Coburn et al. | 407/53 |
| 4,655,005 | 4/1987 | Roberts | 51/124 L |
| 4,901,480 | 2/1990 | Dillon | 51/209 R |
| 5,052,153 | 10/1991 | Wand | 51/209 R |

*Primary Examiner*—Robert A. Rose

*Attorney, Agent, or Firm*—Harness, Dickey & Pierce

[57] ABSTRACT

A fly cutter type ring generator wheel with a novel abrasive grip configuration. The grip configuration requires the largest size grit material to be used on the outer circumferential side of the circumferential axially extending cutting edge. The smallest size grit material is attached to the radiused edge, with a mid sized grit material attached to the inner circumferential surface. The grit configuration gives an improved finish on the lens and reduces the propensity for lens chipping.

7 Claims, 2 Drawing Sheets

FLY CUTTER GENERATOR WHEEL WITH NOVEL DIAMOND GRIT CONFIGURATION TO ELIMINATE LENS FRACTURE AND BACK CUTTING

BACKGROUND OF THE INVENTION

The present invention relates to ring generator wheels for use in grinding of toric lenses in the ophthalmic industry. More particularly, the present invention relates to fly cutter type ring generator wheels which include the combination of a polycrystalline diamond blade with an abrasive grit material thereon on the cutting edge of the wheel.

In recent years there have been several advances in ring generator wheels useful in grinding toric curves in ophthalmic lenses. One highly advantageous improvement has been the use of single or multiple polycrystalline diamond fly cutter blades in combination with an abrasive grit material provided on the radius, inner and outer circumference of the rim portion of the generator wheel. Such generator wheel constructions have increased the efficiency when forming these lenses and have been a great improvement in the ring generator wheel art.

These combination wheels have been found extremely advantageous in concave or "minus" type lenses, however some problems have been experienced when such a wheel is used with "plus" type lenses. During forming of "plus" type lenses with such a wheel, the lenses have tended to chip at the edges unless special procedures or precautions are taken. It was at first thought that the chipping of these "plus" type lenses was caused by the use of the fly cutter blade since chipping was not generally experienced when a standard ring generator wheel having abrasive grit attached was used. However, when utilizing a fly cutter wheel with only blades and no grit attached the problem also did not occur. Thus, the problem was unique to the new combination wheel which includes fly cutter blades and abrasive grit attached thereto. In order to attempt to alleviate this problem it was often necessary when using these new wheels to "back cut" into the lens prior to making the main cut in the lens. Such a technique tended to reduce but did not eliminate chipping at the edges thereof. While such a process is inconvenient for the final user, this process could still accomplish a finished "cut" faster than conventional wheels and therefore was very useful. With recent improvements in such fly cutter wheels and the like, such as that shown in co-pending application Ser. No. 579,869, filed Sept. 6, 1990 by Ronald C. Wiand and entitled: "Cutting Tool With Polycrystalline Diamond Segment and Abrasive", such structures are increasingly becoming more advantageous and effective in the lens cutting and ophthalmic industry.

It has thus been a goal in the art to provide an improved fly cutter wheel which would eliminate this chipping problem thereby reducing the back cutting step and eliminating propensities for edge chipping of lenses. It is therefore, an object of the present invention to provide an improved fly cutter type generator wheel which will eliminate the step of back cutting of lenses and will reduce propensities for lens chipping in the ophthalmic lens forming industry.

SUMMARY OF THE INVENTION

In accordance with the above goals and objectives, the present invention includes an improvement in a fly cutter type generator wheel. Generally, fly cutter generator wheels include a shaft portion, a body portion and a cylindrical lip portion. The cylindrical lip portion has an inside circumference, an outside circumference and a radius portion which connects the inside circumference with the outside circumference. These wheels include at least one polycrystalline diamond blade which extends slightly above the radius portion. The present invention includes an improved grit configuration for reducing the propensity for lens fracture or chipping about the edge of a lens. The improved grit configuration includes a first grit material which is attached to the outer circumference and is relatively coarse. A second grit material is attached to the inner circumference. The second grit material is less coarse than the first grit material. A third grit material is attached to the radius portion of the wheel. The third grit material is of a grit size which is less coarse than the second grit material.

In accordance with the present invention the wheel provides improved lens cutting with little or no chipping, at all speeds. The present invention also reduces the necessity of a back cutting step. Therefore, the present invention is a great improvement over the prior art generator wheels.

Further advantages of the present invention will be readily appreciated by those skilled in the art in light of the drawings taken in conjunction with the specification and the claims appended hereto.

DESCRIPTION OF THE PREFERRED EMBODIMENT

Figure 1:
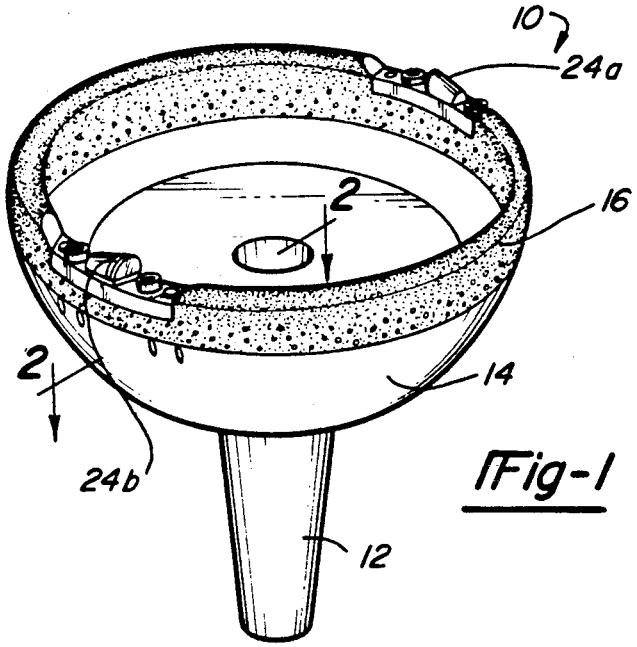
FIG. 1 is a perspective view of a fly cutter generator wheel incorporating the novel grit structure of the present invention.
Figure 2:
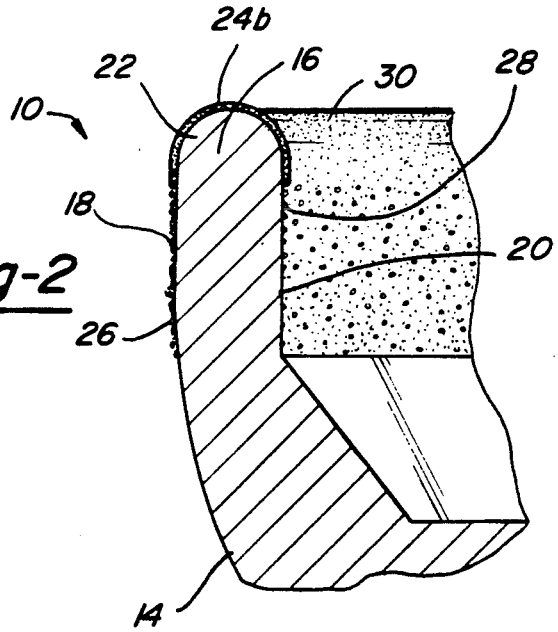
FIG. 2 is a detailed sectional view taken along line 1-1 of FIG. 1 showing the circumferential rim portion of the fly cutter generator wheel, utilizing a novel grit configuration in accordance with the teachings of the present invention.

In accordance with the present invention there is provided a fly cutter-type generator wheel having an improved grit configuration generally indicated at 10 in FIGS. 1 and 2. Fly cutter-type generator wheels in which the novel grit structure of the present invention is useful typically include a shaft portion 12, a body portion 14, and a circumferential lip portion 16 extending from the body portion 14. The lip portion 16 has an outer circumferential side 18, an inner circumferential side 20, and a radiused portion 22. Fly cutter generator wheels typically have at least one polycrystalline diamond blade 24*a*. In the embodiment shown in the drawings, the fly cutter wheel includes two polycrystalline diamond blades 24*a* and 24*b*. Such a blade extends above the radiused portion about 1/16" as is best seen in FIG. 2.

In accordance with the grit configuration of the present invention, a first coarse grit material 26 is attached to the outer circumferential side 18. A second grit material 28 is attached to the inner circumferential side. The second grit material 28 useful in the present invention is less coarse than the first coarse grit material 26 in order to be within the teachings herein. A third grit material 30 is attached on the outer edge of the radiused portion 22. The third grit material 30 is again less coarse than the grit material 20 attached to the inner circumference of the wheel. Thus, the relationship in sizes of grit materials with the largest being on the outer circumference surface the smallest size being on the radiused portion and the inner circumference having a mid sized grit material is critical to the present invention to provide the desired cutting of the lens blank. With such a grit configuration utilized in accordance with the teachings of the present invention, the fly cutter generator wheel may be advantageously utilized in reducing the propensity for lens fracture or chipping, thus reducing the necessity in prior art wheels of back cutting of such lenses, which prior art procedure is illustrated in FIGS. 5 and 6.

Figure 3:
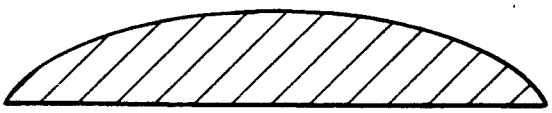
FIG. 3 is a cross-sectional view of a "plus" type ophthalmic lens.
Figure 4:
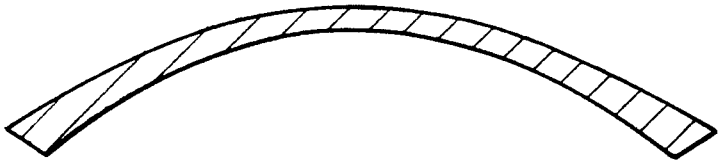
FIG. 4 is a cross-sectional view of a "minus" type ophthalmic lens.

Referring now to FIGS. 3 and 4, there are shown two types of toric lenses which are prepared in accordance with ophthalmic lens grinding procedures used today. FIG. 3 illustrates a typical cross-section of "plus" type lens which is thicker at the center and thinner at the outer edges thereof. The present invention is particularly suited for improved grinding of such a "plus" type lens. FIG. 4 illustrates a typical cross-section of a "minus" type lens which is thin at the center and thicker at the edges. The generator wheel of the present invention is particularly suitable for grinding of the "plus" type lenses, as shown generally in cross-section in FIG. 3. However, the generator wheel of the present invention has also been found to provide faster lens cutting which also results in an improved finished surface on lenses of both the "plus" and the "minus" type.

Figure 5:
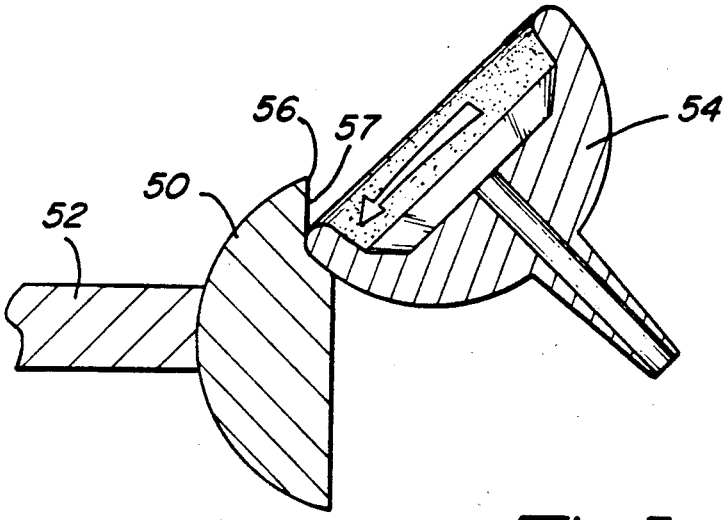
Fig-5 PRIOR ART
FIG. 5 is an illustrative view showing a back cutting operation of a typical prior art process used for forming a "plus" type lens.
Figure 6:
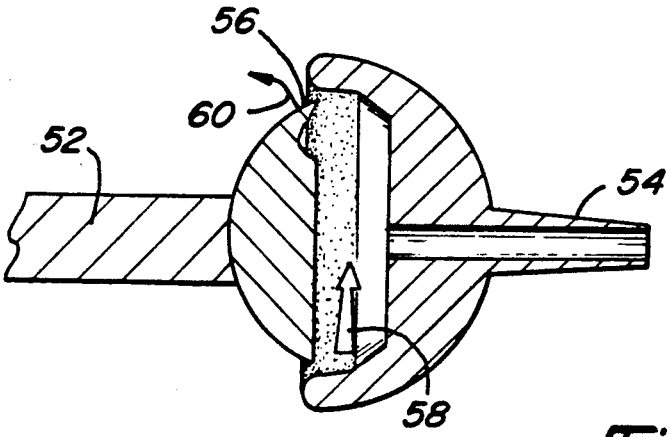
Fig-6 PRIOR ART
FIG. 6 is an illustrative view showing a typical prior process used for forming the final "plus" type lens.

Referring now to FIGS. 5 and 6, there is shown the prior art process for producing such "plus" type lenses. Referring to FIG. 5, there is shown a lens blank 50 which is held by blocking instrument 52. A conventional ring generator wheel 54 is inserted in a conventional forming machine and a first cut is made at the edge of the lens 56 to provide a back cut portion 57 in the lens. The use of such a back cutting technique has been found to help reduce lens chipping using conventional techniques.

Referring now to FIG. 6, after the back cutting step the generator wheel is moved into position as shown therein and the cut is made as illustrated by arrow 58 to produce the final rough cut in the lenses. In the past, during this final cut the lens may be chipped at its edge 56 and a piece or chip accordingly is disconnected from the lens 56 as illustrated by the arrow 60, which of course ruins that particular lens. Thus, in accordance with the present invention, this particular lens chipping problem has been found to be solved in that no back cutting step (such as that shown in FIG. 5) is required utilizing the present invention. Thus, with the generator wheel of the present invention the procedure set forth in FIG. 6 may be utilized to cut the lens without the problem of chipping which is shown in FIG. 6.

The abrasive grit utilized may be diamond like hardness abrasive grits as known to those skilled in the art which may be brazedly attached, electroplated or otherwise bonded to the surfaces thereof. Generally speaking, the grit materials in the structure disclosed above, may be utilized over various coarseness ranges, provided the coarseness relationship between the particles used on each surface is within the particular guidelines of relationships set forth above. Thus, suitable first coarse grit materials 26 for the outside circumference 18 may be utilized in the sizes ranging from about 10 to about 60 grit size, with typical grits ranging from about 18 to about 30 in grit size and preferred grit sizes being in the range of from about 20 to about 25. Second grit material 28 for the inside diameter 20 includes grit sizes ranging from about 15 to about 60, with typical sizes ranging from about 20 to about 50 and preferred grit sizes ranging from about 30 to about 40. The third abrasive grit material 30 utilized on the radius portion includes grit sizes ranging from about 20 to about 80 and typically will have sizes from about 30 to about 70 in grit size, with preferred grit sizes being from about 50 to about 60.

In a preferred embodiment of the present invention, the outside diameter portion 18 has a 20/30 diamond material brazed, to the outside diameter surface 18. The inside diameter 20 includes a 30/40 grit diamond attached thereto, and the radiused portion 22 includes a 50/60 diamond type material attached thereto.

It has been found that utilizing the fly cutter wheel with the above described grit configuration, whether in a single polycrystalline blade, double polycrystalline blade or other multiple bladed fly cutter wheel, the resultant lens has an improved finish over lenses cut with prior art fly cutter wheels or conventional ring generator wheels. The generator wheel of the present invention substantially eliminates the edge chipping problem and the back cutting steps over the range of substantially all of the potential speeds and cuts required from such a wheel.

While the above description constitutes the preferred embodiment of the present invention, it is to be appreciated that the invention is susceptible to modification, variation and change without deviating from the proper scope and fair meaning of the accompanying claims.

What is claimed is:

1. In a fly cutter type generator wheel having: a shaft portion; a body portion; a circumferential axially extending lip portion having an inner circumferential surface, an outer circumferential surface and a radiused portion connecting the inner circumferential surface and the outside circumferential surface; and at least one polycrystalline diamond blade extending slightly above said radiused portion; an improved grit configuration for reducing propensity for lens fracture, said improved grit configuration comprising:

a first coarse grit material attached to said outer circumference;

a second grit material attached to said inner circumference, said second grit material being less coarse than said first coarse grit material; and a third grit material attached to the radiused portion of the wheel, said third grit material being less coarse than said second grit material.

2. The grit configuration of claim 1 wherein said first, second and third grit materials further comprise diamond grit material brazedly attached to said lip portion.

3. The grit configuration of claim 1 wherein said first coarse grit material is selected from the group consisting of grits in sizes ranging of from about 10 to about 60.

4. The grit configuration of claim 1 wherein said second grit material is selected from the group consisting of grits having size ranging of from about 15 to about 60.

5. The grit configuration of claim 1 wherein third grit material is selected from the group consisting of grits having size ranging of from about 20 to about 80.

6. A fly cutter type generator wheel having: a shaft portion; a body portion; a circumferential axially extending lip portion having an inner circumferential surface, an outer circumferential surface with a radiused portion connecting the inner circumferential and the outer circumferential; at least one polycrystalline diamond blade extending slightly above said radiused portion; and an improved grit configuration for reducing propensity for lens fracture, said improved grit configuration comprising:

a first grit material attached to said outer circumference, said first grit material being selected from grit materials having sizes of from about 18 to about 30;

a second grit material attached to said inner circumference, said second material being less coarse than said first grit material and having a grit size of from about 20 to about 50; and a third grit material attached to said radiused portion, said third grit material being less coarse than said second grit material and having a size of from about 30 to about 70.

7. A fly cutter type generator wheel having: a shaft portion; a body portion; a circumferential axially extending lip portion having an inner circumferential surface, an outer circumferential surface with a radiused portion connecting the inner circumferential and the outer circumferential; at least one polycrystalline diamond blade extending slightly above said radiused portion; and an improved grit configuration for reducing propensity for lens fracture, said improved grit configuration comprising:

a first grit material attached to said outer circumference, said first grit material being selected from grit materials having sizes of from about 20 to about 25;

a second grit material attached to said inner circumference, said second material being less coarse than said first grit material and having a grit size of from about 30 to about 40; and a third grit material attached to said radiused portion, said third grit material being less coarse than said second grit material and having a size of from about 50 to about 60.

* * * * *